US008800760B2

(12) United States Patent
Schroeder

(10) Patent No.: US 8,800,760 B2
(45) Date of Patent: Aug. 12, 2014

(54) BOX APPARATUS AND PACKAGING METHODS

(76) Inventor: Richard M. Schroeder, Ramsey, MN (US)

( * ) Notice: Subject to any disclaimer, the term of this patent is extended or adjusted under 35 U.S.C. 154(b) by 243 days.

(21) Appl. No.: 13/019,731

(22) Filed: Feb. 2, 2011

(65) Prior Publication Data

US 2011/0186452 A1 Aug. 4, 2011

Related U.S. Application Data

(60) Provisional application No. 61/300,622, filed on Feb. 2, 2010.

(51) Int. Cl.

| | |
|---|---|
| ***B65D 69/00*** | (2006.01) |
| ***B65D 71/10*** | (2006.01) |
| *B65D 77/24* | (2006.01) |

(52) U.S. Cl.

CPC ..... *B65D 71/10* (2013.01); *B65D 77/24* (2013.01)

USPC ..... 206/232; 206/449; 206/497; 229/87.18

(58) Field of Classification Search

CPC ..... B65D 71/10; B65D 77/24

USPC ..... 206/38, 223, 425, 449, 497, 499, 232; 229/67.3, 68.1, 95, 98.2, 126, 149, 229/181, 87.18, 87.19; 283/58; 493/243, 493/245, 918; 281/15.1, 21.1

See application file for complete search history.

(56) References Cited

U.S. PATENT DOCUMENTS

| | | | | |
|---|---|---|---|---|
| 3,073,508 | A * | 1/1963 | Hiersteiner | 229/67.3 |
| 3,261,537 | A * | 7/1966 | Kistner | 229/149 |
| 5,060,793 | A * | 10/1991 | Hyun et al. | 206/232 |
| 5,085,417 | A * | 2/1992 | Copham | 283/70 |
| 5,251,759 | A * | 10/1993 | Gannon et al. | 206/575 |
| 5,392,912 | A * | 2/1995 | Grubbs | 206/497 |
| 5,490,597 | A * | 2/1996 | Schluger | 206/575 |
| 5,799,862 | A * | 9/1998 | Gray | 229/67.3 |
| 5,921,463 | A * | 7/1999 | Boyle et al. | 229/67.3 |
| 7,185,800 | B2 * | 3/2007 | Lockhart | 229/67.3 |
| 2005/0252809 | A1 * | 11/2005 | Aldridge et al. | 206/449 |

* cited by examiner

*Primary Examiner* — Luan K Bui

(74) *Attorney, Agent, or Firm* — Billion & Armitage; Richard E. Billion

(57) ABSTRACT

A package includes a stack of checkbook blanks, a box in a flat, shipping state placed on the stack; and a wrapper surrounding the stack checkbook blanks, and the box in the flat, shipping state. The wrapper positioned around the stack, and the box can be a film or a paper envelope. The box can be formed from a one piece box blank or can be a two piece box having a top portion and a bottom portion.

10 Claims, 9 Drawing Sheets

BOX APPARATUS AND PACKAGING METHODS

FIELD OF THE INVENTION

The present inventions relates to a box apparatus and methods for forming the box and using the box in fulfillment of various orders.

BACKGROUND

In today's electronic world, check books still have application and are widely used. Surprisingly, some vendors send out millions of new boxes filled with customized personal checks and customized business checks on a yearly basis. Typically, six to eight check books having around 25 checks in each book are sent in erected boxes to various customers from various fulfillment centers.

A constant goal of business is to increase profits. One of the ways a business can increase profits is by cutting costs. With several million boxes of customized check books being sent out annually, significant cost savings can be achieved by saving on postage. Flat packages cost less to ship than an erect box filled with check blanks.

Figure 1:
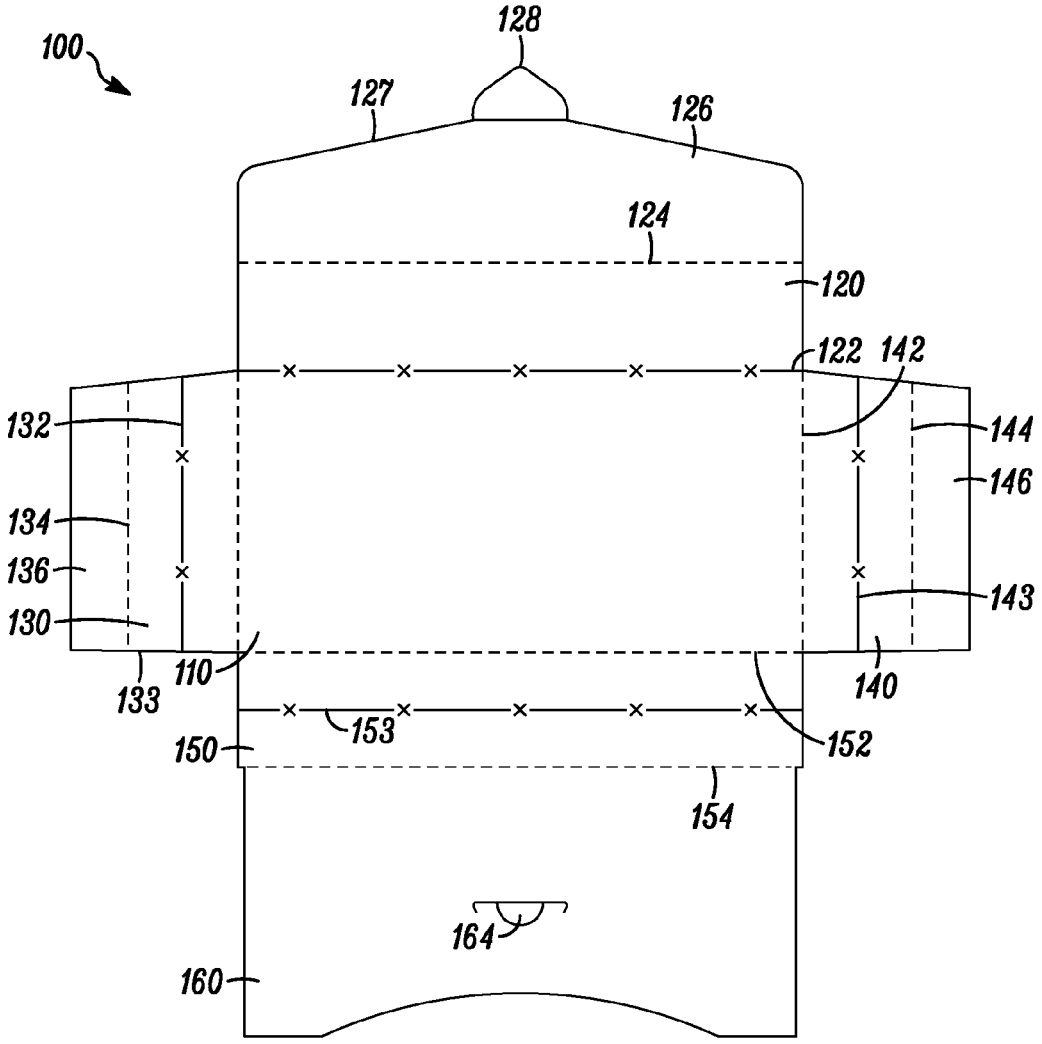
FIG. 1 is top view of a one piece box blank for forming a box, according to example embodiment.

All Figures are illustrated for ease of explanation of the basic teachings of the present invention only; the extensions of the Figures with respect to number, position, relationship and dimensions of the parts to form the preferred embodiment will be explained or will be within the skill of the art after the following description has been read and understood. Further, the exact dimensions and dimensional proportions to conform to specific force, weight, strength, and similar requirements for various applications will likewise be within the skill of the art after the following description has been read and understood.

Where used in various Figures of the drawings, the same numerals designate the same or similar parts. Furthermore, when the terms "top," "bottom," "right," "left," "front," "rear," "first," "second," "inside," "outside," and similar terms are used, the terms should be understood to reference only the structure shown in the drawings and utilized only to facilitate describing the illustrated embodiments.

One aspect of the invention the production of a flat package that includes one or more pads of check blanks that is less costly to ship than a box full of one or more pads of checks. To achieve a flat package, the box had to be eliminated as the package. Consumers still need a container or box in which to hold checks. So a box capable of at least two states was developed. The box is capable of a first state where the box is in a flat state so that it can be included in a flat package. The box is also capable of a second state where the box is in a pad of check blanks receiving position. Several possible boxes exist that meet these criteria.

FIG. 1 is a top view of a one piece box blank 100 used to build a box that has a first flat state and a second check pad receiving state as discussed above. A one piece box blank 100 includes a rear wall portion 110. The rear wall portion 110 can be thought of as the portion to which all other portions are attached, either directly or indirectly through another portion. The one piece box blank 100 also includes a box top 120, a first side wall 130, a second side wall 140 and a box bottom 150 hingedly interconnected to the rear wall portion 110. The hinged interconnection can be a fold line or any treatment of the material of the box blank 100 to promote or cause a fold along a line associated with the hinged interconnection. Many of the hinged interconnections are folds lines shown as dashed lines in FIG. 1. As shown in FIG. 1, there is a hinged interconnection 132 between the first side wall 130 and the rear portion 110, a hinged interconnection 142 between the second side wall 140 and the rear portion 110, and a hinged interconnection 152 between the bottom portion 150 and the rear portion 110. A box top 120 is attached to rear wall portion at a cut crease 122. The cut crease is another hinged connection. The cut crease is more prone to folding than are the fold lines, such as 132, 143, and 153. Hingedly interconnected to the box top 120 along fold line 124 is a front flap 126. The front flap 126 includes a free edge 127. A projection 128 is attached to the free edge 127 of the front flap 126.

A front wall 160 is attached to the box bottom 150 along a hinged interconnection 154. The front wall 160 has an aperture 164 therein. The front wall portion 160 is hingedly interconnected to the box bottom 150. The projection 128 attached to the free edge 127 of the front flap 126 is dimensioned to be received by the aperture 164 in the front wall 160.

A first glue flap 136 is hingedly interconnected, as depicted by 134, to the first side wall 130, and a second glue flap 146 is hingedly interconnected, as depicted by 144, to the second side wall 140. The first side wall 130, the second side wall 140 and the box bottom 150 each has substantially the same width dimension, and each of the first side wall 130, the second side wall 140 and the box bottom 150 having a cut crease transverse to the width of these walls. The first side wall includes cut crease 133, the second side wall includes cut crease 143, and the box bottom 150 includes cut crease 153.

When the front wall portion 160 is adhered to the first glue flap portion 136 and the second glue flap portion 146, a box is formed which is capable of two states. The two states include a substantially flat shipping state and an erected check blank pad receiving state. The cut creases 133, 143, 153 in the formed box bifurcate the first side wall portion 130, and the second side wall portion 140, and the box bottom portion 150, respectively.

Figure 2:
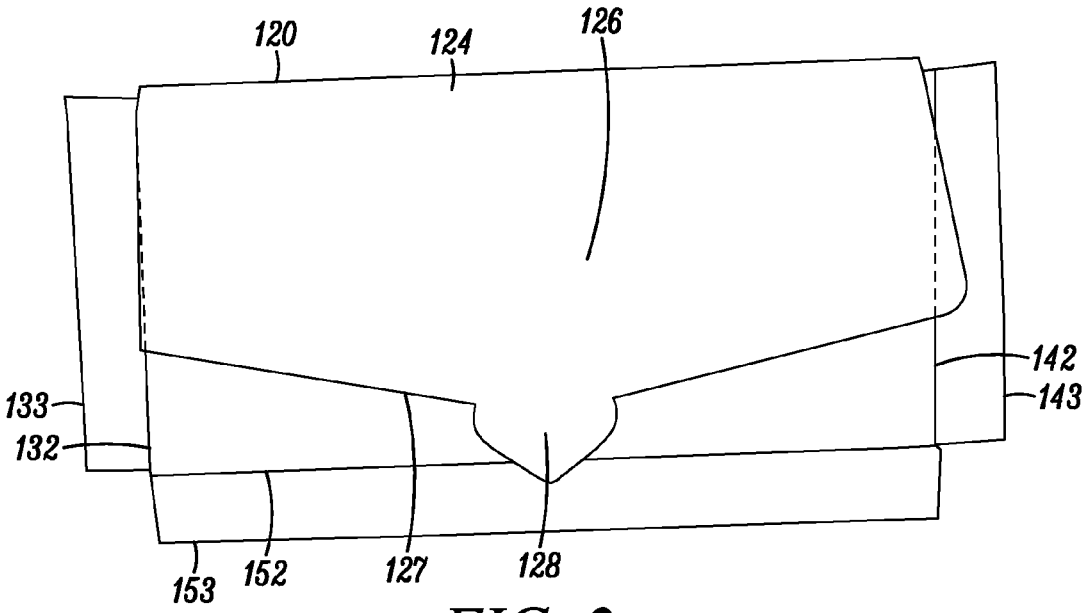
FIG. 2 a top view of a glued and assembled box in a flat, shipping state, according to an example embodiment.
Figure 3:
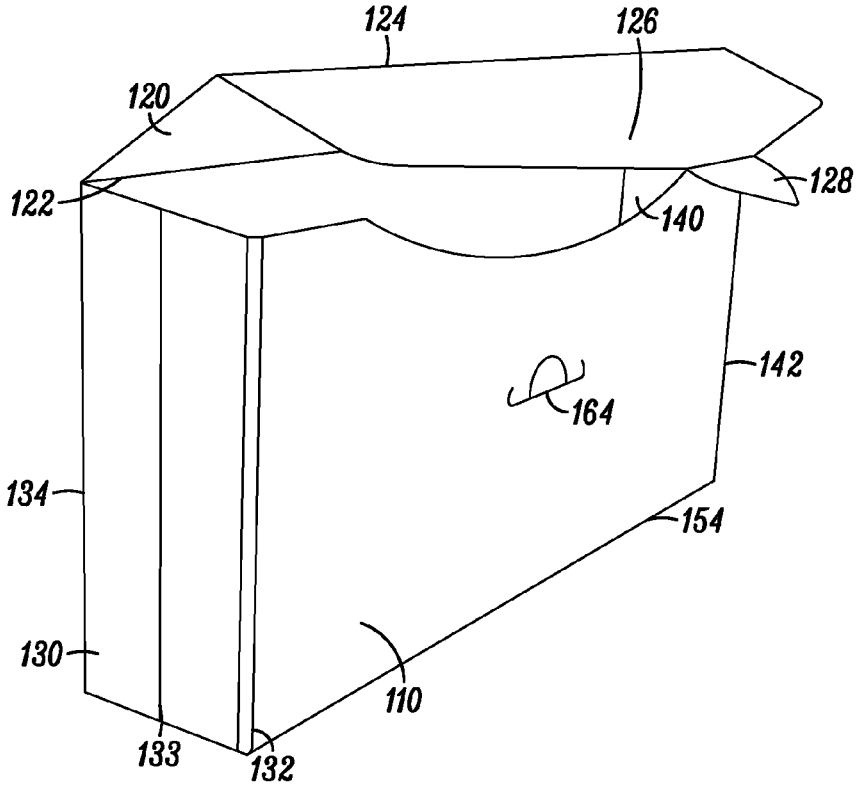
FIG. 3 is a perspective view of a glued and assembled box in an erected state for receiving one or more pads of check blanks, according to an example embodiment.

The cut creases 122, 133, 143, 153 enable the formed box to take the flat shipping state. The cut creases 122, 133, 143, 153 also enable the formed box to move from the flat shipping state to a blank check pad receiving state and back again. FIG. 2 shows the assembled and adhered box 100 in a flat, shipping state or first state. FIG. 3 shows the assembled and adhered box 100 in an erected or check book pad receiving state or second state. Movement between these two states is intuitive so that the person receiving the box in the flat or shipping state merely pinches the box to place it in the second state where the assembled box 100 is ready to receive one or more pads of blank checks. Thus, when a customer receives the box, they can remove it from the package and quickly move it from its flat shipping state to an erect state where it is ready to receive pads of check blanks If the pads of check blanks are also received at the same time, the customer gathers the pads, places them in the box 100. The projection 128 on the front flap 126 extends into the aperture 164 to close the box 100.

Now referring to FIGS. 1 and 3, the width or thickness of the first side wall 130, the second side wall 140, the box bottom 150, and the box top 120 is dimensioned to accommodate the thickness of one or more check book pads. In other words, the box 100 can have a width or thickness of slightly more than the thickness of two pads of check blanks in one embodiment. In another embodiment, the width of the box 100 and specifically the width or thickness of the first side wall 130, the second side wall 140, the box bottom 150 and the box top 160 accommodates six pads of check blanks. The width or thickness, w, of the first side wall 130 is shown in FIG. 1. The other widths are the dimension between the hinged interconnections to the rear portion 110 and any other portion.

The formed box 100 includes a printable area or an embossable area 170. The printable or embossable area 170 is shown in hidden lines in FIG. 1 since the printable area is below the surface shown from the top view. Financial institutions print or emboss a logo or other advertising on the box that will be presented to the user of the checks at least each time the user needs a new pad of check blanks The box 100 can be formed from a paper product, such as chip board, paper board, cardboard, corrugated cardboard or the like. The box 100 can also be formed from a plastic.

Figure 4:
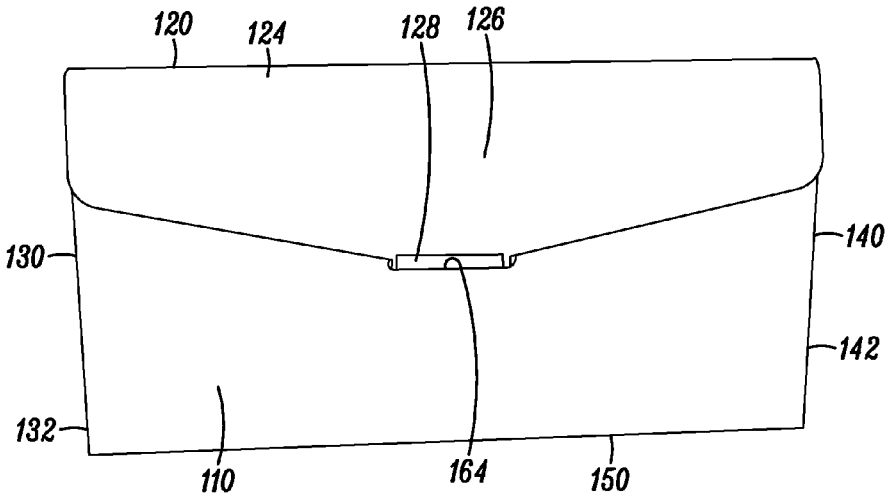
FIG. 4 is front perspective view of the box in a closed orientation in an erected state, according to an example embodiment.

FIG. 4 is front perspective view of the box 100 in a closed orientation in an erected state, according to an example embodiment. The formed box 100 encloses the contents of the box (pads of blank checks) by engaging the projection associated with the front flap 126 with the aperture 164 in the front wall 160.

The flat box 100 is one example of a flat box that is needed to form a flat package to achieve a flat package for obtaining postal savings when sending out checks. The box 100 has the advantage of moving easily between the flat, shippable first state and the second state where it is ready to receive one or more pads of check blanks. It should be noted other boxes may be used. For example, a two part box may also be shipped in a flat state to achieve the postal savings. A two part box includes a flat box bottom and a flat box top. The consumer has to assemble the box top and the box bottom and inserts the checkbook pads in the box bottom. Flat packages can be formed using either box. Both example embodiments will be described below.

Figure 5:
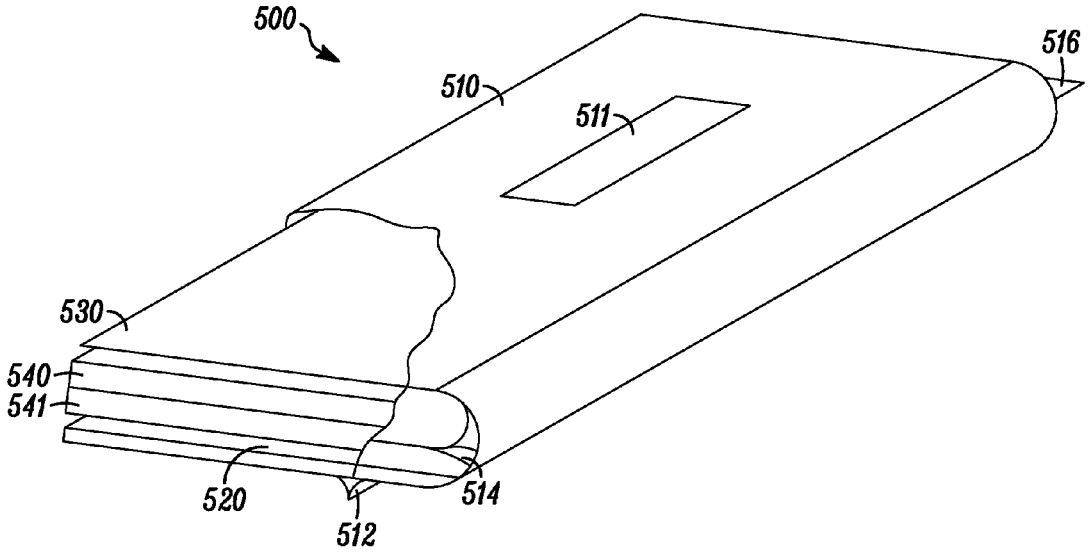
FIG. 5 is cutaway perspective view of a package including a film placed around a flat envelope placed on stacks of pads of blank check and placed on a substrate, according to an example embodiment.

FIG. 5 is perspective view of a package 500 including a film 510 placed around a substrate 520 carrying a box 530 placed on stacks of pads of blank check 540, 541, and 542, 543, 544, 545 (shown in FIG. 6), according to an example embodiment. The pads of blank checks 540, 541, 542, 543, 544, 545 are positioned so that the length of the pads of blank checks is transverse to the length dimension of the package 500. As a result, only two of the pads of checks can be seen in FIG. 5. The box 530 shown in FIG. 5 is a flat box that could be either the flat box 100 formed from a single piece of stock, or a flat box that includes two pieces that have to be assembled by the customer upon receipt of the package 500. The substrate 520 is a thin, light piece of stock. It can be made of paper or plastic. The film 510 is a plastic film having sufficient durability to withstand the rigors of shipping. The film 510 is placed around the substrate 520, the pads of check blanks, and the flat box 530. The edges of the film 510 are heated to seal the film circumferentially around the contents. The resulting edge 512 runs substantially down the length of the package 500. The ends of the film are also heat sealed and form ends 514 and 516. The film 500, in one embodiment, includes a transparent window 511 through which an address label can be read. In one embodiment, the substrate 520 carries an address associated with the order being fulfilled and the address on the substrate corresponds to the position of the window 511.

Figure 6:
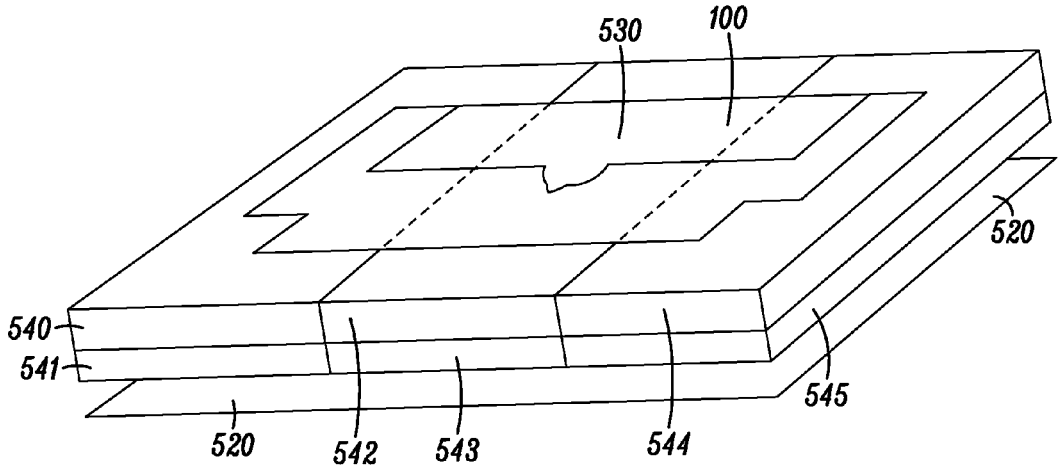
FIG. 6 is perspective view of the contents of the package shown in FIG. 5. The contents include a flat box placed on stacks of pads of blank check placed on a substrate, according to an example embodiment.

FIG. 6 is perspective view of a flat box 100 placed on stacks of pads of blank checks 540, 541, 542, 543, 544, 545 are placed on a substrate 520, according to an example embodiment. FIG. 6 shows the contents of the package 500 according to one example embodiment. The pads of checks 540, 541, 542, 543, 544, 545 are formed two to a stack. Three stacks of two pads are shown in FIG. 6. The length of the pads is transverse to the length of the package 500. Therefore six pads of blank checks can be placed in the package 500. In some embodiments, the stacks of pads of blank checks can be stacks of one pad of check blanks making for a total of three pads of check blanks The packages can include more items such as a check book register, a checkbook cover, advertising inserts and the like.

Figure 7:
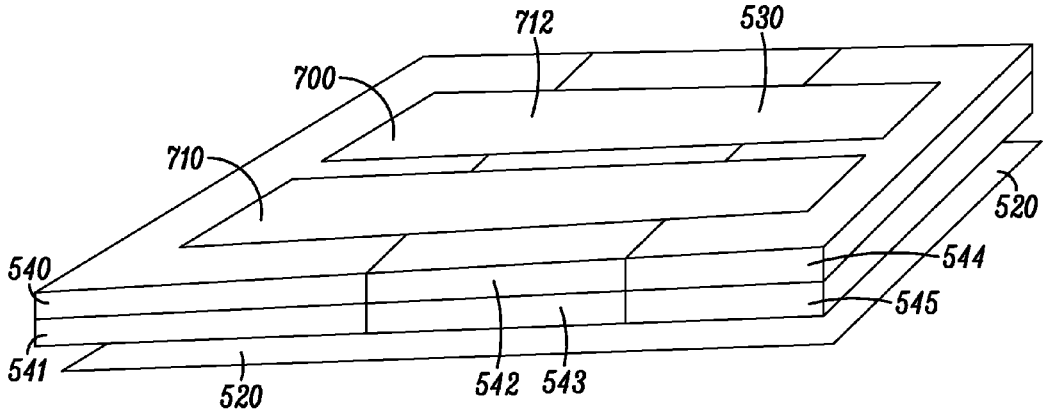
FIG. 7 is perspective view of another set of contents of the package shown in FIG. 5. The contents include a two part flat box placed on stacks of pads of blank check placed on a substrate, according to an example embodiment.

FIG. 7 is perspective view of a flat box 700 placed on stacks of pads of blank checks 540, 541, 542, 543, 544, 545 placed on a substrate 520, according to an example embodiment. The flat box 700 includes a box bottom 710 and a box top 712. The box bottom 710 is separate from the box top 712. FIG. 7 shows the contents of the package 500 according to another example embodiment. The pads of checks 540, 541, 542, 543, 544, 545 are formed two to a stack. Three stacks of two pads are shown in FIG. 7. The length of the pads is transverse to the length of the package 500. Therefore six pads of blank checks can be placed in the package 500. In some embodiments, the stacks of pads of blank checks can be stacks of one pad of check blanks making for a total of three pads of check blanks. The packages can include more items such as a check book register, a checkbook cover, advertising inserts and the like. When the customer receives the package, the customer must assemble the box bottom and place the contents of the package into the bottom 710 of the box 700. The box top 712 must also be erected and placed on top of the box bottom 710 by the customer.

Figure 8:
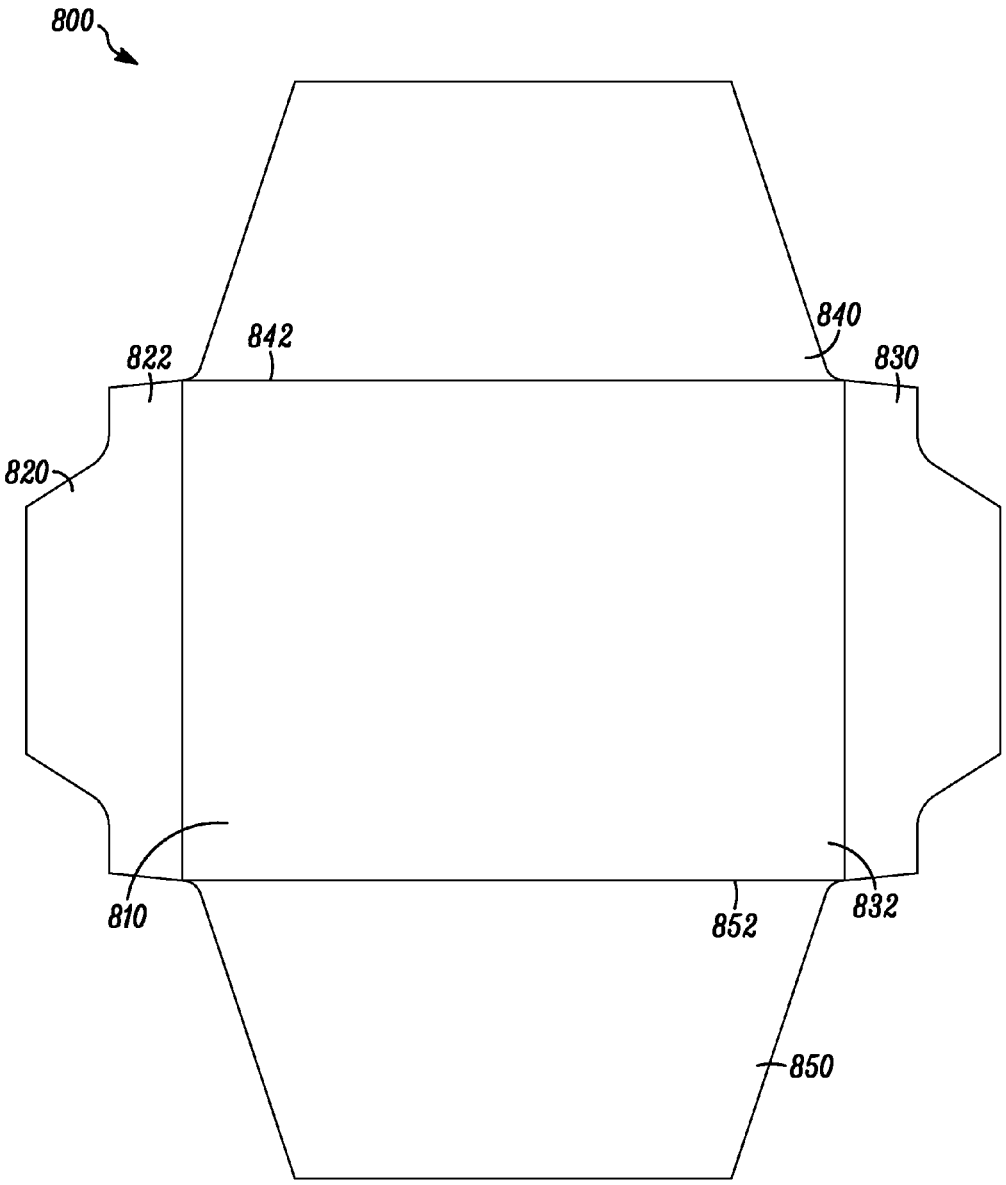
FIG. 8 shows a top view of a substrate that also is used as the wrapper or wraps around the contents of the package, according to another embodiment.

FIG. 8 shows a top view of a substrate 800 that also is used as the wrapper or wraps around the contents of the package, according to another embodiment. The substrate 800 doubles as the wrapper. The substrate 800 includes a central front portion 810. A first side flap 820 and a second side flap 830 are hingedly interconnected to the central front portion 810 along fold lines 822 and 832, respectively. The substrate 800 also includes a top flap 840 and a bottom flap 850 which are hingedly interconnected to the central front portion 810 along fold lines 842 and 852, respectively.

Figure 9:
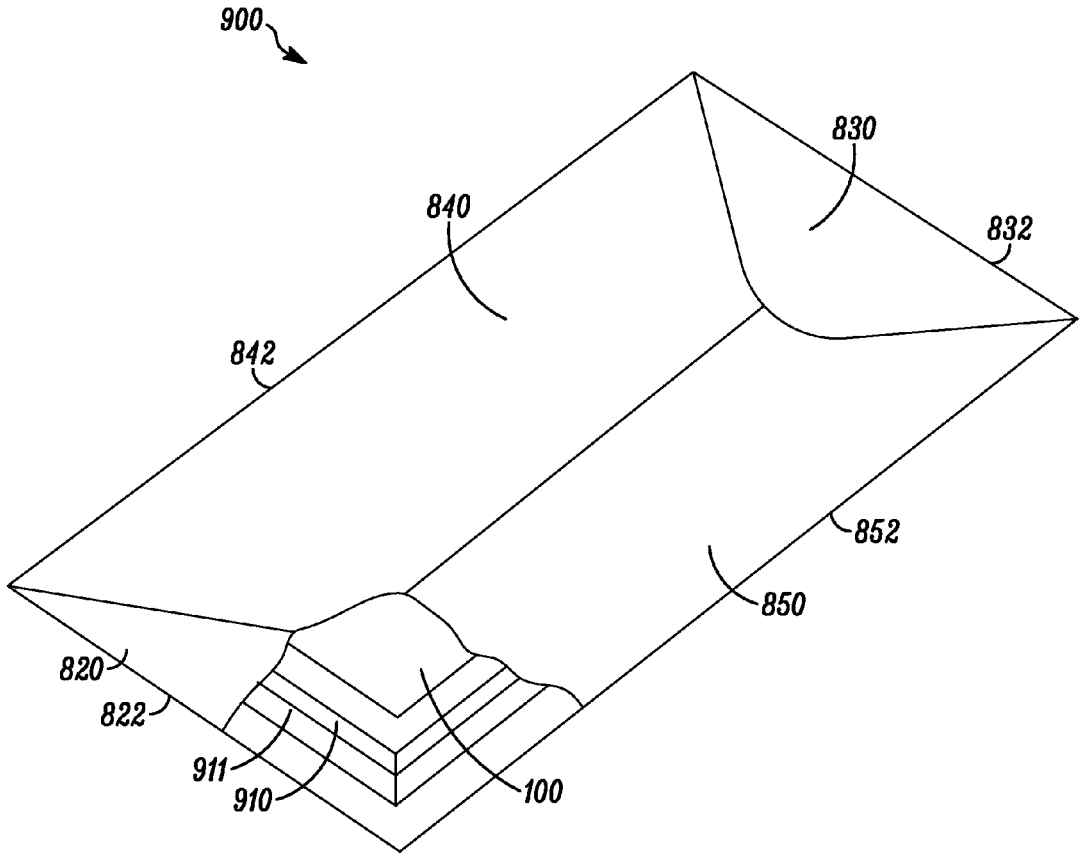
FIG. 9 is a perspective view of the package formed from the substrate, according to an example embodiment.

The substrate 800 is populated with the contents of a package 900 (shown in FIG. 9). Generally, the contents of the package are placed within the bounds of the front portion 810 of the substrate. Once the contents have been placed onto the substrate 800, the side flaps 820, 830 are folded along fold lines 822, 832, respectively. The bottom flap 850 is also folded along the fold line 852 to cover the contents. The top flap 840 is folded along the fold line 842. The top flap 840 overlaps with the bottom flap 850. An adhesive is placed on the overlapping portion to complete the wrapper which in turn completes the package 900.

FIG. 9 is a perspective view of the package formed from the substrate 800, according to an example embodiment. The package 900 includes a stack of checkbook blanks 910, 911, a box 100 in a flat, shipping state placed on the stack; and a wrapper 800 that surrounds the contents of the package. In this case the substrate used is also the wrapper 800. Glue or adhesive is placed on one of the top flap 840 or the bottom flap 850. The glue is a quick setting adhesive. The package 900 is flipped and an address label is affixed to the front portion 810 to complete the package 900. In addition to the two pads 910, 911 and the box 100 in the flat, shipping state, other items can also be placed on the substrate 800 before folding over the tabs and placing the adhesive to complete the package. The other contents include a check register, a checkbook cover, and other inserts, such as advertising inserts. Although the package 900 shown in FIG. 9 includes two pads of blank checks 910, 911, it is contemplated that the package could be used to send a single pad off check blanks to a customer. Furthermore, it is contemplated that in other embodiments, the substrate and wrapper 800 can be dimensioned to carry more than two pads of blank checks.

Each of the packages 500 and 900 described above include a stack of checkbook blanks, a box in a flat, shipping state placed on the stack; and a wrapper surrounding the stack checkbook blanks, and the box in the flat, shipping state. The wrapper positioned around the stack. The wrapper can be made of a film or a paper product. In one embodiment the contents of the package 500, 900 includes a second stack, and a third stack of checkbook blanks In one embodiment, the package 500 formed from a film has a length in a range of 11-16 inches, a height in a range of between 5-13 inches, and a thickness in a range between 0.125-1.000 inches. In another embodiment, the paper product wrapper is also the carrier. The paper product acts as the wrapper and is formed around the stack including at least one pad of check blanks, and the box. The package 900 formed from the paper wrapper, in one embodiment, has a length in a range of 4.5-12 inches, a height in a range of between 3-7 inches, and a thickness in a range between 0.007-0.300 inches. Of course, the stack or stacks of checkbook blanks, in some embodiments, include a single pad of check book blanks or include a plurality of checkbook blanks.

Figure 11:
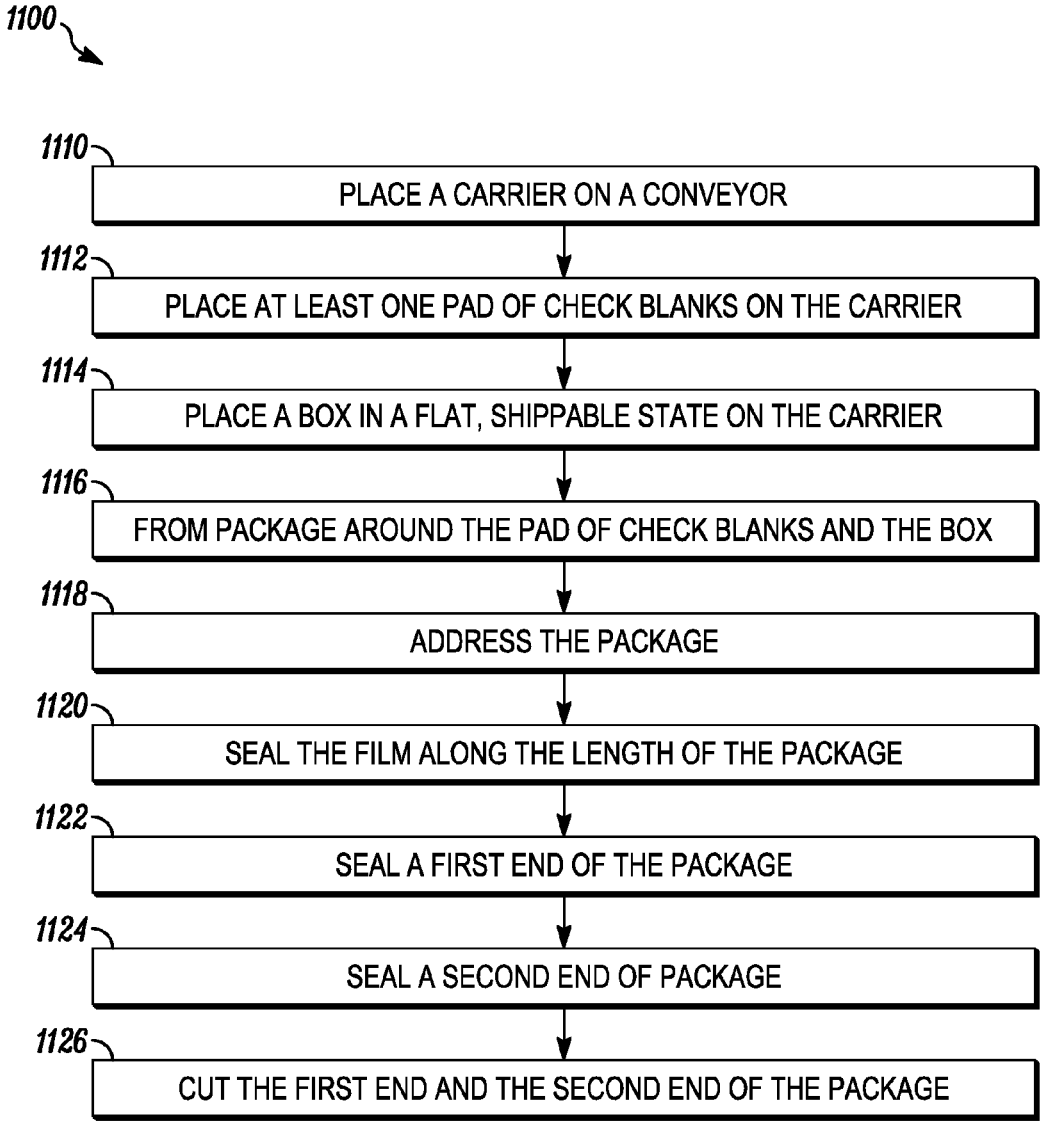
FIG. 11 is a flow diagram of another method of packaging pads of checkbook blanks, according to an example embodiment

FIG. 11 is a flow diagram of a method 1100 of packaging pads of checkbook blanks, according to an example embodiment. The method 1100 of packaging includes placing a carrier on a conveyor 1110, placing at least one pad of check blanks on the carrier 1112, placing a box in a flat, shippable state on the carrier 1114, forming a package around the pad of check blanks and the box 1116, and addressing the package 1118. In another embodiment, the carrier substrate can be populated by hand. For example, placing at least one pad of check blanks on the carrier, and placing a box in a flat, shippable state on the carrier; can be done by hand. In still another embodiment, forming a package around the pad of check blanks and the box includes placing a film around the carrier, the at least one pad of check blanks. Forming the package 1118 further includes sealing the film along the length of the package 1120, sealing a first end of the package 1122, sealing a second end of the package 1124, and cutting the first end and the second end of the package 1126. The sealing elements, in one embodiment, include placing a heating element in contact with the film to effectuate the seal. Sealing the film along the length of the package can includes placing a heating element in contact with the film to effectuate the seal as the package is being conveyed, detecting when the package is substantially motionless, and disengaging the heating element when the package is motionless. This prevents melting of the film when the package stops conveying. The method 1100 can also includes placing at least three pads of check blanks on the carrier. In some instances, six pads of check blanks are placed on the carrier. Generally the pads of check blanks and placed in stacks of two check blank pads a piece.

Figure 10:
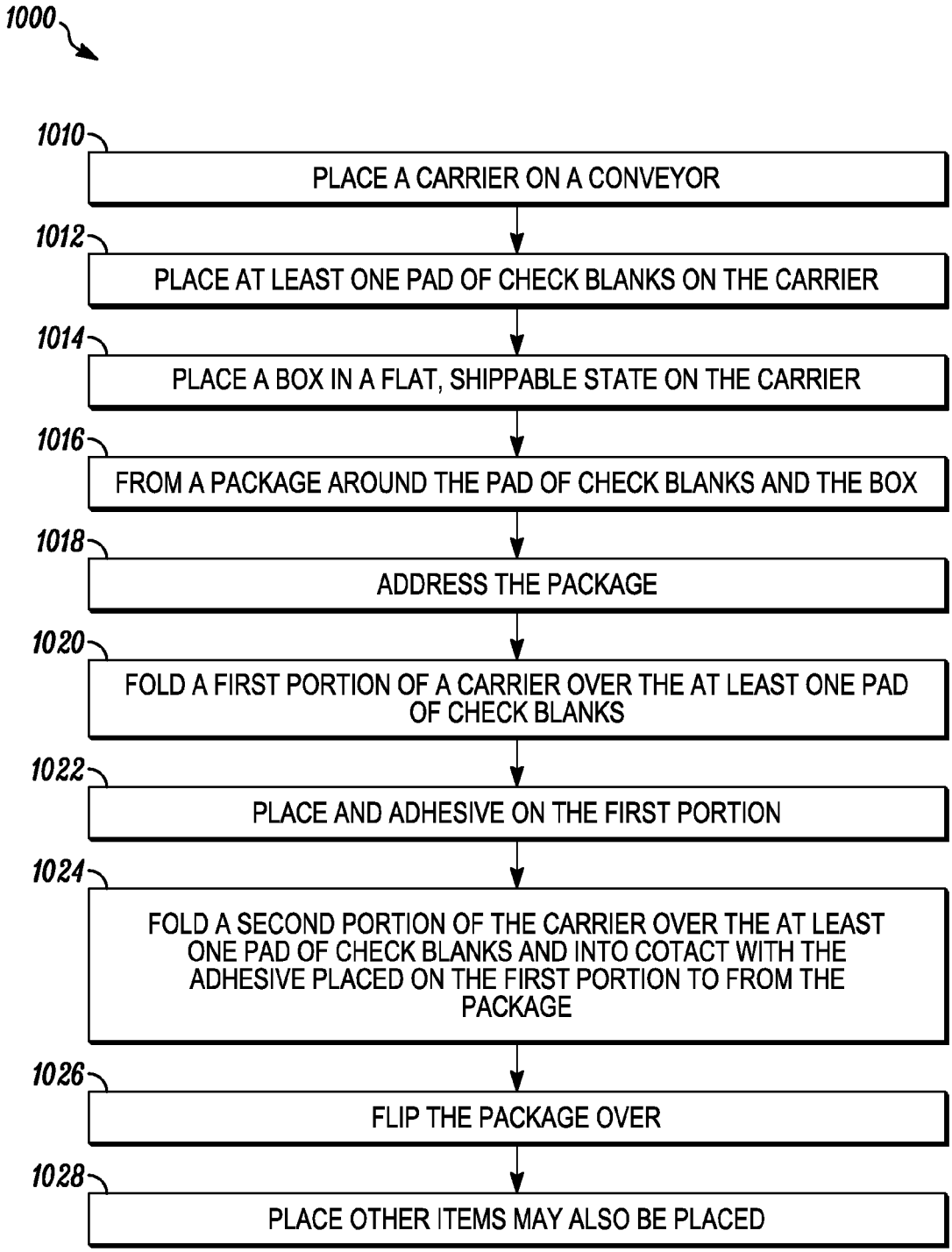
FIG. 10 is a flow diagram of a method of packaging pads of checkbook blanks, according to an example embodiment.

FIG. 10 is a flow diagram of a method 1000 of packaging pads of checkbook blanks, according to an example embodiment. The method 1000 of packaging includes placing a carrier on a conveyor 1010, placing at least one pad of check blanks on the carrier 1012, placing a box in a flat, shippable state on the carrier 1014, forming a package around the pad of check blanks and the box 1016, and addressing the package 1018. In one embodiment, the carrier placed on the conveyor is formed into the package around the pad of check blanks and the box. The method 1000 also includes folding a first portion of a carrier over the at least one pad of check blanks 1020, placing an adhesive on the first portion 1022, and folding a second portion of the carrier over the at least one pad of check blanks and into contact with the adhesive placed on the first portion to form the package 1024. The method 1000 also includes flipping the package over 1026 before addressing the package. In one embodiment, a vacuum pick and place device is used to place the box in a flat, shippable state on the carrier. The method 1000 can also include selecting a checkbook cover from a plurality of checkbook cover locations, and placing the selected checkbook cover onto the carrier. A vacuum pick and place device is used to place the checkbook cover on the carrier. In some embodiments, other items may also be placed 1028 onto the carrier including advertising inserts and the like. There may be more than one advertising insert. A bar code can be read to determine the inserts to be added to the package. The barcode can also be used to determine which checkbook cover to add as there may be a plurality of check book blanks from which to choose. Many aspects of placement can be automated.

Figure 12:
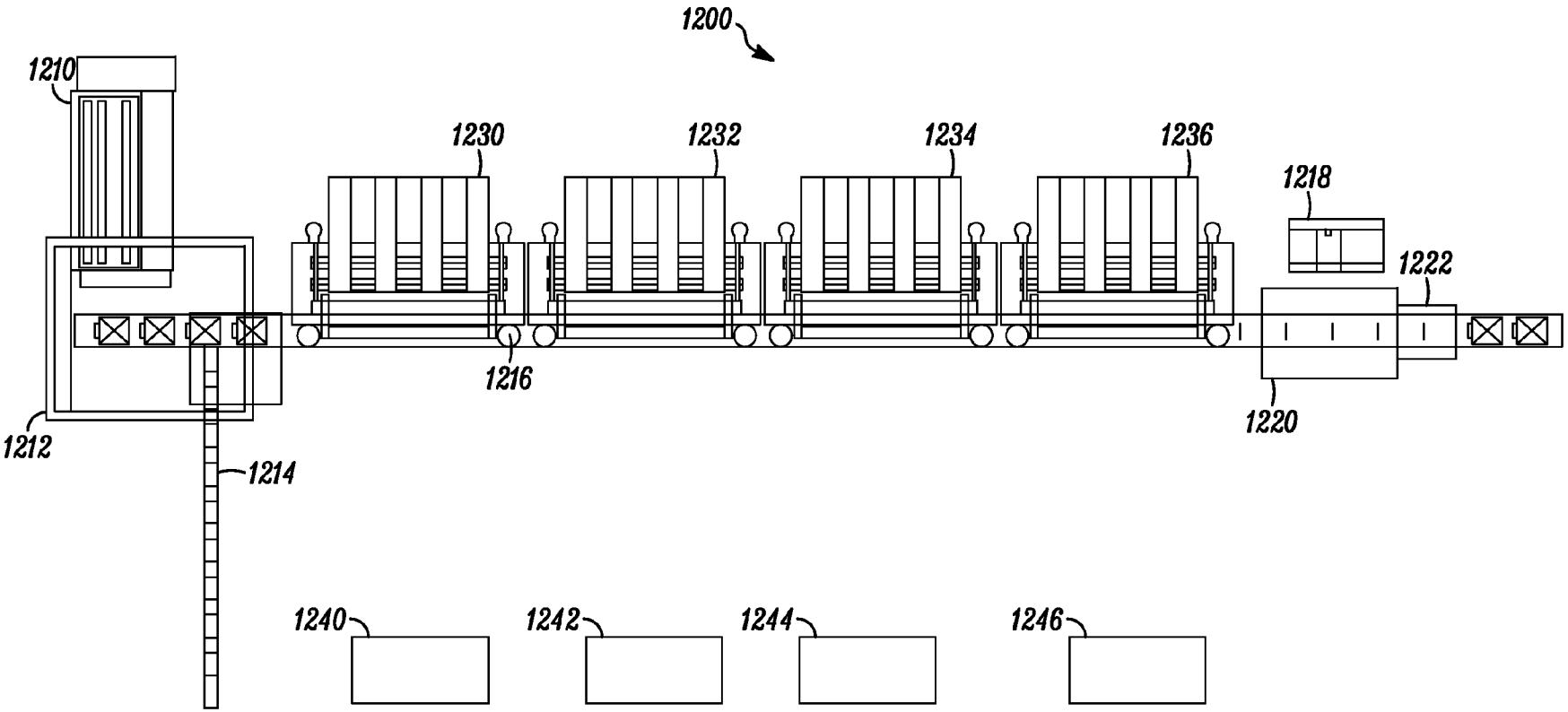
FIG. 12 is side view of a machine for processing and automating the packaging and formation of packages that include a flat box placed on stacks of pads of blank check placed on a substrate, according to an example embodiment.

FIG. 12 is side view of a machine 1200 for processing and automating the packaging and formation of packages that include a flat box placed on stacks of pads of blank check placed on a substrate, according to an example embodiment. In this particular embodiment, the machine 1200 includes a carton magazine 1210, a carton former 1212, a check pad conveyer 1214, a main conveyor 1216, a glue system 1218, a carton closer 1220, and a carton inverter 1222. The carton magazine 1210 is loaded with a carrier used as a content wrapper 900. The carton magazine 1210 delivers the carrier 900 to the carton former 1212 and to main conveyor line 1216. The carrier is partially formed so that it can be folded at the carton closer 1220 near the end of the machine 1200. The partially formed carrier proceeds down the main conveyor line 1216 to the check pad conveyor 1214 where check pads are loaded onto the carrier. At least one check pad is delivered and placed onto the carrier. In another embodiment, a plurality of check pads is placed onto the carrier. Information about the order of check blanks is associated with the check blanks loaded onto the carrier. In one embodiment, a bar code associated with the check pads is read. In one embodiment, the bar code is linked to a data base that includes the desired other contents to load onto the carrier which has been partially formed. For example, the order may be from a bank that has a customized box 100. The box 100 will carry the name of the bank on the embossable or printable area 170 of the box 100. Another alternative may be a generic box 100. The machine includes several bins that hold boxes 100 of varying types, advertising inserts, check registers, and the like. As shown in FIG. 12, there are four sets 1230, 1232, 1234, 1236 of four bins. This makes sixteen possible bins from which to pick materials from to add to the carrier. In one embodiment, these are picked by hand. In another embodiment, sets of vacuum pickups 1240, 1242, 1244, 1246 are used to pick selected materials from the sets of bins for placement onto the carrier. The vacuum pick ups selectively pick materials from the bins and place it on the carrier along with a box 100. The vacuum pick ups are associated with pick and place machines. Once picked up, the machine moves the item to the carrier or to the main conveyor 1216 and places the material onto the carrier as it passes by on the conveyor. The conveyor may move continuously or may move and stop at each station in various embodiments. Once the carrier is fully populated with the materials, it is conveyed via conveyor 1216 to the glue system 1218 and carton closer 1220. The glue system 1218 applies an adhesive to the carrier or wrapper, and then the carton closer closes the wrapper and holds the wrapper for an amount of time such that the glue will hold the completed package. In some instances, the amount of time may only be the amount of time necessary to fold and close the wrapper or carrier. The conveyor 1216 then moves the completed package to the carton inverter 1222 where the package is flipped over and an address is applied. The addressed package is then moved on for mailing.

In another embodiment, the machine can include a source of plastic wrap. The carrier is left on the conveyor and the contents of the package and the carrier are wrapped with the plastic wrap. The wrap is sealed along its length and sealed at the two ends. The package is cut, addressed and shipped. In this embodiment, the contents of the package can be hand picked and placed. This includes hand picking and placing a box such as the box 100 or a flat box top and a flat box bottom. The placement of the contents of the package can also be done using bins and a pick and place machine similar to the one discussed with respect to FIG. 12. Although a few variations have been described and illustrated in detail above, it should be understood that other modifications are possible. In addition it should be understood that the flow depicted in the accompanying figures and described herein do not require the particular order shown, or sequential order, to achieve desirable results. Other embodiments may be within the scope of the following claims.

Certain aspects of the example embodiments include a method of packaging comprising: placing a carrier on a conveyor; placing at least one pad of check blanks on the carrier; placing a box in a flat, shippable state on the carrier; forming a package around the pad of check blanks and the box; and addressing the package. Another aspect of the example embodiment of the method of packaging listed above wherein the carrier placed on the conveyor is formed into the package around the pad of check blanks and the box. Another aspect of the example embodiment of the method of packaging listed above further comprises folding a first portion of a carrier over the at least one pad of check blanks; placing an adhesive on the first portion; and folding a second portion of the carrier over the at least one pad of check blanks and into contact with the adhesive placed on the first portion to form the package. In another aspect of the method further comprises flipping the package over before addressing the package. Another aspect of the method of the first aspect mentioned in this paragraph wherein a vacuum pick and place device is used to place the box in a flat, shippable state on the carrier. Yet another aspect of the mentioned method further comprises: selecting a checkbook cover from a plurality of checkbook cover locations; and placing the selected checkbook cover onto the carrier. More specifically, the method just mentioned wherein a vacuum pick and place device is used to place the checkbook cover on the carrier. The method of the aspect first mentioned wherein placing at least one pad of check blanks on the carrier, and placing a box in a flat, shippable state on the carrier; are done by hand. The method first mentioned wherein forming a package around the pad of check blanks and the box includes placing a film around the carrier, the at least one pad of check blanks. The method just mentioned wherein forming a package further includes: sealing the film along the length of the package; sealing a first end of the package; sealing a second end of the package; and cutting the first end and the second end of the package. The method of the preceding sentence wherein the sealing steps further comprise placing a heating element in contact with the film to effectuate the seal. Sealing the film along the length of the package includes: placing a heating element in contact with the film to effectuate the seal as the package is being conveyed; detecting when the package is substantially motionless; and disengaging the heating element when the package is motionless. Placing at least one pad of check blanks can include placing at least three pads of check blanks on the carrier.

The foregoing discussion discloses and describes merely exemplary embodiments of the present inventions. Upon review of the specification, one skilled in the art will readily recognize from such discussion, and from the accompanying figures and claims, that various changes, modifications and variations can be made therein without departing from the spirit and scope of the invention as defined in the following claims.

What is claimed is:

1. A package comprising:

a stack of checkbook blanks;

a box in a flat, shipping position placed on the stack; and a wrapper surrounding the stack checkbook blanks and the box in the flat, shipping position, wherein the box is formed from a one piece box blank, the box blank comprising: a rear wall portion having a box top, a first side wall, a second side wall and a box bottom hingedly interconnected to the rear wall portion: a front wall portion having an aperture therein; the front wall portion hingedly interconnected to the box bottom; a front flap portion hingedly interconnected to the box top along a first edge, the front flap portion having a free edge; a projection attached to the free edge of the front flap portion, the projection dimensioned to be selectively received by the aperture in the front wall portion; a first glue flap hingedly interconnected to the first side wall; and a second glue flap hingedly interconnected to the second side wall, the first side wall, the second side wall and the box bottom each having substantially the same width dimension, and each of the first side wall, the second side wall and the box bottom having a cut crease transverse to the width of these walls.

2. The package of claim 1 wherein the box formed from the one-piece box blank has the front wall adhered to the first glue flap portion and the second glue flap, the formed box capable of a substantially flat shipping position and an erected checkbook receiving position.

3. The package of claim 1 wherein the cut creases bifurcate the first side wall, and the second side wall, and the box bottom.

4. The package of claim 1 wherein the wrapper is a film positioned around the stack, and the box.

5. The package of claim 1 further including: a second stack of checkbook blanks; and a third stack of checkbook blanks.

6. The package of claim 4, wherein the package has a length in a range of 11-16 inches, a height in a range of between 5-13 inches, and a thickness in a range between 0.125-1.000 inches.

7. The package of claim 1 wherein the wrapper is a paper product formed around the stack and the box.

8. The package of claim 1, wherein the package has a length in a range of 4.5-12 inches, a height in a range of between 3-7 inches, and a thickness in a range between 0.007-0.300 inches.

9. The package of claim 1 wherein the stack of checkbook blanks includes a plurality of checkbook blanks.

10. The package of claim 1 wherein the box is capable of a second state in which the box can receive at least the checkbook blanks shipped in the package.

* * * * *